US009114583B2

(12) United States Patent
Schmeink

(10) Patent No.: US 9,114,583 B2
(45) Date of Patent: Aug. 25, 2015

(54) PLUNGER DRIVE WITH LOAD PROFILE ADAPTATION

(75) Inventor: Martin Schmeink, Salach (DE)

(73) Assignee: SCHULER PRESSEN GMBH + CO. KG, Goppingen (DE)

( * ) Notice: Subject to any disclaimer, the term of this patent is extended or adjusted under 35 U.S.C. 154(b) by 605 days.

(21) Appl. No.: 12/927,842

(22) Filed: Nov. 26, 2010

(65) Prior Publication Data

US 2011/0132207 A1 Jun. 9, 2011

(30) Foreign Application Priority Data

Dec. 8, 2009 (DE) ..... 10 2009 057 409

(51) Int. Cl.
*B30B 15/14* (2006.01)
*B30B 15/00* (2006.01)
*B30B 1/26* (2006.01)

(52) U.S. Cl.
CPC ..... *B30B 15/0094* (2013.01); *B30B 1/26* (2013.01); *B30B 15/148* (2013.01)

(58) Field of Classification Search
CPC ..... B21J 7/12; B21J 15/18; B21J 9/18; B21J 15/28; B21J 7/32; B21J 7/28; B21D 5/02; B21D 5/0272; B30B 1/266; B30B 15/24; B30B 15/041; B30B 15/007; B30B 9/125; B30B 15/163; B30B 15/0094; B30B 9/3007; B30B 15/14; B30B 1/263; B30B 15/0035; B30B 1/26; B30B 15/148; A01F 15/0825
USPC ..... 72/438, 441, 443; 100/35, 43, 46, 48, 100/49, 50
See application file for complete search history.

(56) References Cited

U.S. PATENT DOCUMENTS

| | | | | |
|---|---|---|---|---|
| 4,354,147 | A * | 10/1982 | Klaussner | 318/363 |
| 5,899,103 | A * | 5/1999 | Ooenoki et al. | 72/31.1 |
| 6,070,521 | A * | 6/2000 | Otoshi | 100/48 |
| 7,102,316 | B2 * | 9/2006 | Beyer et al. | 318/625 |
| 7,434,505 | B2 * | 10/2008 | Suzuki et al. | 100/43 |
| 2006/0156933 | A1 * | 7/2006 | Hofele et al. | 100/281 |
| 2007/0101841 | A1 * | 5/2007 | Fahrenbach | 83/13 |
| 2008/0016940 | A1 * | 1/2008 | Schmeink | 72/435 |
| 2008/0127839 | A1 * | 6/2008 | Fahrenbach | 100/214 |
| 2008/0168910 | A1 * | 7/2008 | Dexling et al. | 100/35 |
| 2009/0200968 | A1 * | 8/2009 | Behr et al. | 318/161 |

FOREIGN PATENT DOCUMENTS

| | | |
|---|---|---|
| DE | 10 2006 033 562 B3 | 2/2008 |
| DE | 10 2004 009 256 B4 | 4/2008 |
| DE | 10 2005 040 263 A1 | 11/2010 |

* cited by examiner

*Primary Examiner* — Shelley Self
*Assistant Examiner* — Onekki Jolly
(74) *Attorney, Agent, or Firm* — R. S. Lombard; K. Bach

(57) ABSTRACT

A method of operating a servo press and apparatus therefore, including a press plunger and a servo drive and such a press, the press plunger is operated in accordance with a predetermined guide angle/position-curve based on a guide angle α and the movement of the plunger is controlled in accordance with this curve with a tolerance which depends on the guide angle α.

13 Claims, 2 Drawing Sheets

PLUNGER DRIVE WITH LOAD PROFILE ADAPTATION

CROSS-REFERENCE TO RELATED APPLICATION

This application claims the priority benefits of German Application No. 10 2009 057 409.3 filed Dec. 8, 2009.

BACKGROUND OF THE INVENTION

The invention resides in a method for operating a servo press and in a press equipped with a servo drive.

For the transformation of massive metal components as well as for the deformation of metal sheets increasingly presses are used whose plungers are driven preferably by an electric servo drive. In this respect, DE 10 2006 033 562 B3 discloses presses whose plungers are driven by servomotors. The servomotors provide for the respective plungers an up and down stroke movement in accordance with a predetermined guide angle/position-curve. With the programmable control of the servomotors guide angle/position-curves can be achieved which to a large extent or even precisely approximate curves as they were generated in the past by mechanical presses. Also novel curves which can not be realized with mechanical presses can be achieved. The servo drive follows the predetermined curves as precisely as possible. To this end the servo drive is generally controlled on a position basis.

Such presses are also known from DE 10 2004 009 256 B4. This printed publication discloses the drive of a press plunger via an interposed eccentric drive by several servomotors. Of the servomotors at least one is operated on a position control basis. In this way, the desired guide angle/position-curve is obtained which is also designated travel distance-time curve. The printed publication also discloses to operate one of the motors on a position control basis and the other motor on a force or torque control basis. In this way it is avoided that individual servomotors operate in opposition to one another because of contradicting position measurements. It is made possible thereby that, overall, the predetermined travel distance-time-curve is maintained.

Between the plunger and a press table, that is driving the transformation of a work piece, generally substantial forces are effective which result in an elastic deformation of the press when the plunger reaches the lower dead center position. The press table, the plunger and the press head part may be subjected to elastic bending. The press frame and the crank may be elastically stretched or compressed. With this elastic deformation a substantial deformation energy is stored in the components mentioned which energy is again released to drive the plunger after it has passed the lower plunger dead center position. The press drive then acts as a brake and moves the plunger away from the press table in a controlled manner while dissipating the elastically stored energy.

In a servo press, this braking energy must be accommodated by the servo drive. This is an additional load for the servo drives. Additional forces to be accommodated by the servo drive may originate from the tool or the manufacturing process. For example, nitrogen springs (uncontrolled) drawing equipment, ejectors or similar devices may be provided, for example arranged in the plunger. Such equipment is effective over a relatively long distance and result in the above-mentioned increased load.

It is the object of the present invention to improve the operation of a servo press with a press plunger and a servo drive for driving the press plunger.

SUMMARY OF THE INVENTION

A method of operating a servo press and apparatus therefore, including a press plunger and a servo drive and such a press, the press plunger is operated in accordance with a predetermined guide angle/position-curve based on a guide angle $\alpha$ and the movement of the plunger is controlled in accordance with this curve with a tolerance which depends on the guide angle $\alpha$.

In accordance with the method according to the invention the servo drive of a press plunger is moved in accordance with a predetermined guide angle/position-curve which represents the desired movement of the plunger. Immediately following the bottom dead center position of the press plunger however a deviation from this desired guide angle/position-curve is permitted. In other words, for a limited guide angle range a higher position tolerance is permitted. This concerns in particular a positive position tolerance, wherein the plunger is disposed at a greater distance from the press table than determined by the guide angle/position-curve. In this way, the braking torque of the servo drive can be reduced for a certain guide angle range following the bottom dead center position of the plunger. The energy stored in the elastically deformed element of the press can be used for the acceleration of the upper-tool part, the plunger and the drive train. If the movement of the plunger as predetermined by the guide angle/position-curve is slower than the movement caused by the relaxation of the press, the servo drive at least does not brake that movement but rather permits an acceleration of the moving parts. As a result the plunger moves faster while the energy stored in the elastic parts is re-converted into kinetic energy of the press drive. The deviation of the plunger position from the desired position is accepted preferably at least as long as the plunger is above the desired position. The servo drive therefore does not have to work or at least needs to work to a smaller extent against the force effective on the plunger that is it is subjected to a lower load.

The load relief of the servo drive results in particular in a reduction of the effective torque and, in this way, in a load reduction of the one or several servomotors which drive the plunger. The servomotors need to convert less braking energy which reduces the thermal load of the servomotors. The load relief can be utilized by using possibly smaller servomotors than would otherwise be necessary. Also the energy to be converted in the transverter can be reduced. In addition the energy to be retransmitted to the electric power supply or the intermediate storage device can be reduced whereby the intermediate storage device, if present, can be smaller and power supply load variations can be reduced.

It is possible to eliminate the counterforce to be applied by the servo drive for braking the upward movement of the plunger after passing the bottom dead center or to control it to a value other than zero. This value maybe a predetermined constant value. But it can also be determined to be guide angle or time-dependent. In this way, smooth operational transitions between the position-controlled operation and the force-controlled operation of the servomotor are possible. This operational transition preferably concerns all the servomotors forming the servo drive or at least the otherwise position controlled servomotors at this same time.

Further details and advantageous embodiments of the invention will become more readily apparent from the following description with reference to the accompanying drawings.

DESCRIPTION OF A PARTICULAR EMBODIMENT

Figure 1:
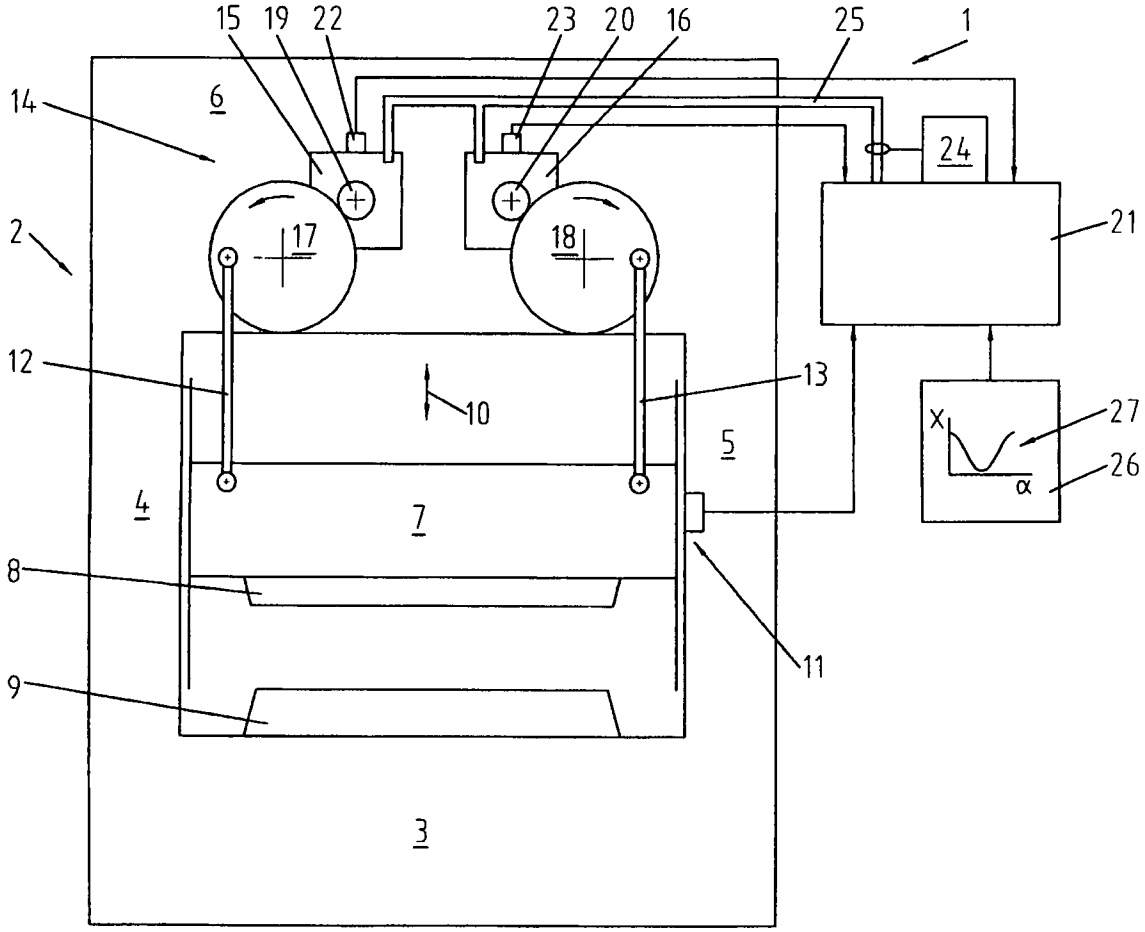
FIG. 1 shows schematically the press according to the invention.

In FIG. 1 a servo press 1 is schematically shown in an abstract manner and limited to a few components. The servo press I comprises a press frame 2 which includes, for example, a press table 3, a press stand 4, 5, and a top part 6. On the press frame 2, a plunger 7 may be movably supported. In the exemplary embodiment, the plunger 7 is arranged above the press table 3 and is movable vertically preferably along a linear line up and down. The plunger 7 carries a top tool 8. The press table carries the corresponding bottom tool 9. The movement of the plunger 7 in the direction of the arrow 10 is defined as the X-direction. For detecting the plunger movement, optionally, an X-position sensor 11 may be provided.

The plunger 7 may be connected via suitable drive means, for example, two connecting rods 12, 13, to a servo drive 14 which is arranged, for example, in the top part 6. The servo drive comprises, for example, one or several servomotors 15, 16 which are suitable for driving eccentrics 17, 18 or other means for the conversion of drive movements to a plunger movement. The servomotors 15, 16 can drive the eccentrics directly. Alternatively they may have drive shafts with pinions 19, 20 which are in engagement with an outer gear structure of the eccentrics 17, 18 as shown in FIG. 1 and, in this way, form a gear drive connection.

Also, another drive connection between the at least one servomotor 15 and the plunger 7 may be provided.

The servo drive is controlled by a control arrangement 21 which operates the servomotors 15, 16 preferably on a generally position controlled basis. To this end, the X-position sensor 11 or alternatively, depending on the circumstances, also additionally at least one further position sensor 22, 23 is provided for example for detecting the rotational position of the pinion or the rotor of the servo motor 19 and/or 20 and/or for detecting the rotational position of the eccentric 17 and/or 18. The position sensors 22, 23 may be for example a rotational signal transmitter. They are connected to the control arrangement 21.

Furthermore, a force sensor arrangement 24 may be provided for sensing the force effective on the plunger 7 or, alternatively a drive- or braking torque of the servomotors 15, 16. In the present exemplary embodiment this is done by monitoring the motor current in the power lines 25 leading to the servomotors 15, 16. The control arrangement 21 controls the servomotors 15, 16 in accordance with the guide angle/position-curve 27 predetermined by a control unit 26. This may be recorded for example as a set of data in a storage device. Other means, which are not shown, may be provided as input and/or for changing these guide angle/position-curve may be provided.

The guide angle/position-curve establishes a connection between a plunger position X and a press guide angle $\alpha$. The press guide angle $\alpha$ is here, the angle of an imaginary but no longer existing eccentric shaft, which in conventional presses is part of the plunger drive and which, with a full rotation, permits the plunger to move one time from the upper dead center to the lower dead center and back again. Instead of the "guide angle $\alpha$" in connection with the present invention also a time-based criterion may be used.

Figure 2:
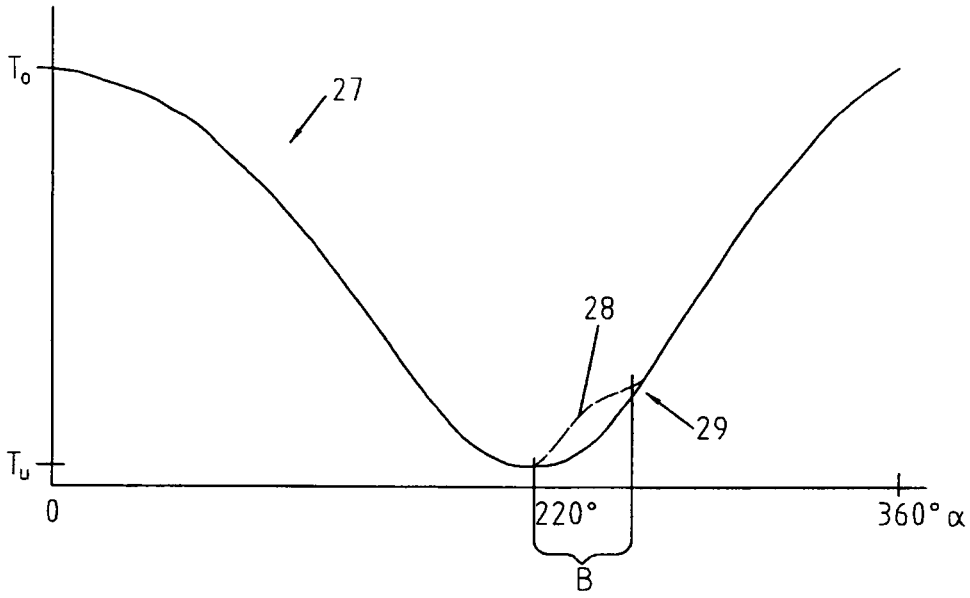
FIG. 2 shows a diagram of a guide angle-dependent course of the movement of the press plunger.

The guide angle/position-curve 27 is separately shown in FIG. 2. It represents the oscillation of the plunger between its upper dead point To and its lower dead point Tu. The lower dead point Tu is shown here at a guide angle $\alpha$ of 220°. If in place of the guide angle $\alpha$, a time-based criterion scale is used and a full press stroke takes, for example, 3600 ms (milliseconds) the lower dead center Tu is disposed at 2200 ms. The guide angle/position-curve 27 serves only explanation purposes. Otherwise, shaped curves with a slower approach to the lower dead center point Tu as they are used in connection with draw presses may also be applied as well as other further modified guide angle/position-curves.

The control arrangement 21 is a position control arrangement which generally control the servomotors 15, 16 in such a way that the plunger 7 follows the guide angle/position-curve 27 with the smallest possible tolerance Tol 1. This principle however is not followed by the control arrangement 21 immediately after passage of the bottom dead center position Tu of the plunger. In the guide angle area B, shown in FIG. 2, the admissible tolerance with which the plunger 7 follows the guide angle/position-curve 27 is at least increased or preferably even fully omitted. The release however relates at least to positive tolerances that are to those cases in which the distance X of the plunger 7 from the press table 3 exceeds the distance as determined by the guide angle/position-curve 27. The control arrangement permits the increase of the tolerance in that it is set to a value greater or equal (>=) maximum plunger stroke or by replacing the position controlled operating mode of the servomotors 15, 16 for the range B by a force controlled or, respectively, torque-controlled operating mode.

Alternatively, the servomotors 15, 16 may be completely deactivated for the guide angle area B, that is they are switched to be deenergized. As a result, the plunger 7 follows a curve which, at least in the range B, deviates clearly from the guide angle/position-curve 27, but which otherwise coincides substantially, that is within a narrow tolerance. The phase following the passage of the lower dead center point Tu in the guide angle area B wherein a deviation of the plunger movement from the guide angle/position-curve 27 is permitted, is the phase in which the elastic energy stored in the press part 2 and the drive train between the servomotors 15, 16 and the plunger 7 and possibly in other energy stores is recuperated. Such other energy stores may be, for example, nitrogen springs included in the plunger as the tool or similar.

Figure 3:
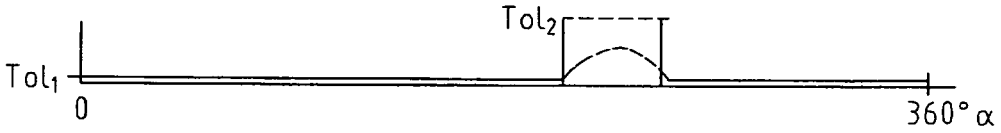
FIG. 3 shows the respective guide angle-dependent position tolerance in the form of diagram; and, FIG. 4 shows a diagram of a guide angle dependent position force course.

The plunger movement obtained with a certain stroke number is shown in FIG. 2 by a dashed line section 28 of the curve. As shown, the actual plunger movement as indicated by the curve section 28 deviates in the guide angle area B noticeably from the predetermined guide angle/position-curve 27. The tolerance as shown in FIG. 3 is quite large. The tolerance however can remain below an upper tolerance limit value Tol 2 if this value is selected to be large enough or if the tolerance limit is completely eliminated at least toward increased deviation X by a switch over from the position-controlled unit of operation to a force-controlled operation.

The load relief of the drive by the tool forces after passage of the bottom dead center of the plunger and also the frame resiliency are time dependent and mostly independent of the stroke frequency. The program for the permission of a control deviation of the plunger position is established to operate of various stroke frequencies. Therefore, for different stroke frequencies, curve patterns are established which differ from those shown in FIGS. 2-4. For example, the length of the range B as well as the size of the actually admissible tolerance FIG. 3 can be varied based on stroke frequency (FIG. 3).

Figure 4:
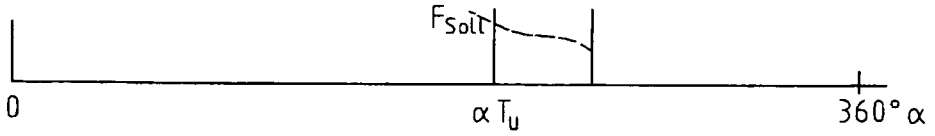

Within the guide angle range B the servomotors 15, 16 may be controlled so as to be deenergized. The whole elastically stored energy is then utilized for the acceleration of the plunger 7 that is the energy of the upper tool and the drive train. This is expedient in many cases. But it may also be expedient to use at least a part of the elastically stored energy, for example, for braking the servomotors 15, 16 in a generator mode. It would also be possible to energize the servomotors in a controlled manner in order to generate a limited braking counter force effective on the plunger. This force may be limited by the control arrangement 21 to a fixed value or it may be controlled, for example, on a time basis as it is shown in FIG. 4. For serving the force effective on the plunger 7 or, respectively, the torque at the servomotors 15, 16 the current flowing in the power lines 25 can be monitored by force sensor arrangements.

The servo press 1 described herein operates as follows:

During operation, the servo drive moves the plunger 7 first in accordance with a guide angle/position-curve 27 from the upper dead center To to the lower dead center Tu. During this step, the control arrangement 21 maintains a very close tolerance so that the plunger 7 follows the predetermined curve 27 very accurately. When the bottom dead center Tu has been reached or has been passed, the control arrangement 21 switches to a different mode in which a deviation of the position X of the plunger 7 from the predetermined guide angle/position-curve 27 at least up to a value X is possible and permitted. At the same time, the servomotors 15, 16 are deenergized or mildly braked. This is done over a guide angle range B which may be predetermined. When the end of the range B has been reached the control arrangement switches back to a position-controlled operation with little tolerance.

The end of the guide angle range B may be fixed. It may also be adjustable. It is also possible to determine it adaptively. For example, the control arrangement 21 may be so designed that it switches automatically back to a position controlled operation when the actual plunger position X coincides with the predetermined guide angle/position-curve.

In a further development, to switch back slowly to a position controlled operation when the deviation between the actual plunger position and the plunger position given by the guide angle/position-curve 27 approaches the value zero, so that a smooth transition between the curve section 28 and the guide angle/position-curve 27 is achieved. This is indicated in FIG. 2 at the transition location 29.

The invention resides in the operation of a servo press 1 after the plunger 7 passes the bottom dead center Tu position. When the plunger 7 reaches the bottom dead center Tu, energy is stored in the press frame and the drive train because of the elastic frame deformation that has occurred at this point.

After passing the bottom dead center Tu, the plunger 7 moves again upwardly. The forces resulting from the elastic deformation act on the drive train so as to accelerate it. The control of the servo drive 14 operates normally in opposition to those forces which forms any additional load. In accordance with the invention, the movement of the plunger 7 is no longer braked by the servo drive 14, but an acceleration of the plunger 7 is permitted when the predetermined movement is slower than the movement of the plunger caused by the outer forces and torques. The plunger 7 moves therefore faster as the elastically stored energy is at least partially reconverted into kinetic energy of the press drive and the plunger.

Depending on the particular tool, subsequently the control is reactivated and the drive is again synchronized to the guide angle/position-curve. In a press drive with very different plunger speeds ahead and after the bottom dead center Tu the drive train can be protected because it is switched to operate torque-free after the bottom dead center.

In addition, the new desired curve can, for example, additionally be adapted to the curve section 28 actually followed by the plunger, for example, in order to increase the smoothness of the transfer operation.

REFERENCE NUMERALS

1 servo press
2 press frame
3 press table
4, 5 stand
6 top part
7 plunger
8 upper tool
9 lower tool
10 arrow
11 X-position sensor
12, 13 connecting rods
14 servo drive
15, 16 servomotors
17, 18 eccentric
19, 20 pinion
21 control arrangement
22, 23 position sensors
34 force sensor arrangement
25 power lines
26 control unit
B guide angle range
27 guide angle/position-curve
28 curve section
29 location
Tu, To dead centers
Tol permitted tolerance area
α guide angle

What is claimed is:

1. A press (1) comprising:

a press frame (2) including a press table (3), a plunger (7) which is supported in the press frame (2), the plunger (7) having a cycle so as to be movable back and forth between a pair of upper dead center positions (To) and a lower plunger dead center position (Tu), a servo drive (14) including at least one servomotor (15, 16) for driving the plunger (7) and means for utilizing an elastic deformation of the press (1) to provide a substantial mechanical deformation energy to aid or replace the at least one servomotor (15, 16) for obtaining a load relief for the at least one servomotor (15, 16) in braking the plunger (7) after plunger has past the lower plunger dead center position (Tu), wherein the means for utilizing an elastic deformation of the press (1) to provide a substantial mechanical deformation energy to aid or replace the servo drive (14) for obtaining a load relief for the at least one servomotor (15, 16) after plunger has past the lower plunger dead center position (Tu) comprises a control arrangement (21) in operative controlling relationship with the servo drive (14), the control arrangement (21) for controlling the servo drive (14) to control the movement of the plunger (7) as follows:

in a first operating mode in accordance with a predetermined guide angle/position-curve (27) based on a guide angle (α) during a first part of the plunger cycle between a first upper dead position (To) and the bottom dead center (Tu) using a position control for controlling and permitting a first deviation of the plunger (7) above the predetermined guide angle/position-curve (27) defining a first position tolerance (Tol 1) substantially accurately following the predetermined guide/angle position-curve (27), and then for operating the press plunger (7) by controlling the movement of the plunger (7) in a second part of the plunger cycle immediately past bottom dead center position (Tu) by switching to a second operating mode using a position control or a force control for permitting a second deviation of the plunger (7) from the predetermined guide/angle position curve (27) defining a second position tolerance (Tol 2) for a predetermined guide angle range (B) or which second position tolerance (Tol 2) may be fully omitted and wherein the plunger (7) may be disposed at a substantially greater distance from the press table (3) then in the first operating mode, and, and then for operating the press plunger (7) by controlling the movement of the plunger (7) in the second part of the plunger cycle past the predetermined guide angle range (B) by switching back to the first operating mode.

2. The press according to claim 1, wherein the servo drive (14) is provided with at least one position sensor (11, 22) for sensing the plunger deviation or a position of the servo drive (14).

3. The press according to claim 1, wherein at least one force sensor arrangement (24) is associated with the servo drive (14) for sensing the plunger force or a value corresponding to the plunger force.

4. The press according to claim 1, wherein the control arrangement (21) controls the plunger servo drive (14) in a position-controlled manner and, after the plunger has passed the lower plunger dead center position (Tu), the plunger drive (14) is operated for the limited guide angle range (B) in a force-controlled manner.

5. The press according to claim 1, wherein the control arrangement (21) in the second operating mode deenergizes the at least one servomotor (15, 16) for the guide angle range (B).

6. A method for operating a servo press (1) including a press plunger (7) having a cycle with a bottom dead center position (Tu) that passes through a pair of upper dead center positions (To) and a servo drive (14) including at least one servomotor (15, 16), said method comprising the following steps:

in a first step operating the press plunger (7) by controlling the movement of the plunger (7) in a first operating mode in accordance with a predetermined guide angle/position-curve (27) based on a guide angle ($\alpha$) during a first part of the plunger cycle between a first upper dead center position (To) and the bottom dead center position (Tu) using a position control for controlling and permitting a first deviation of the plunger (7) above the predetermined guide angle/position-curve (27) defining a first position tolerance (Tol 1) substantially accurately following the predetermined guide/angle position-curve (27), in a second step operating the press plunger (7) by controlling the movement of the plunger (7) in a second part of the plunger cycle immediately past bottom dead center position (Tu) by switching to a second operating mode using a position control or a force control for permitting a second deviation of the plunger (7) above the predetermined guide/angle position-curve (27) defining a second position tolerance (Tol 2) for a predetermined guide angle range (B) or which the second position tolerance (Tol 2) may be fully omitted and wherein the plunger (7) may be disposed at a substantially greater distance from the press table (3) then in the first operating mode, and, in a third step operating the press plunger (7) by controlling the movement of the plunger (7) in the second part of the plunger cycle past the predetermined guide angle range (B) by switching back to the first operating mode.

7. The method according to claim 6, wherein the servo drive (14) is operated with position control.

8. The method according to claim 6, wherein the second position tolerance (Tol 2) of the plunger (7) after passage of the bottom dead center position (Tu) is asymmetrical at least for the limited guide angle range (B).

9. The method according to claim 6, wherein the plunger (7) after passage of the bottom dead center position (Tu) is permitted to move upwardly at a speed exceeding that predetermined by the guide angle/position-curve (27).

10. The method according to claim 9, wherein, after the plunger (7) has passed the bottom dead center position (Tu), the servo drive (14) is force-controlled for a limited guide angle range (B) on the basis of a predetermined desired force (F).

11. The method according to claim 10, wherein the desired force (F) is a constant value.

12. The method according to claim 10, wherein the desired force (F) is determined depending on the guide angle ($\alpha$).

13. The method according to claim 6, wherein in the second step the at least one servomotor (15, 16) is switched to be deenergized for the guide angle range (B).

* * * * *